United States Patent [19]

Lundbäck

[11] Patent Number: 4,946,075

[45] Date of Patent: Aug. 7, 1990

[54] DEVICE FOR DISPENSING FLOWING SUBSTANCES

[75] Inventor: Rune Lundbäck, Gävle, Sweden

[73] Assignee: Unro Teknik AB, Gävle, Sweden

[21] Appl. No.: 372,776

[22] Filed: Jun. 29, 1989

[51] Int. Cl.[5] ..... B67D 3/02

[52] U.S. Cl. ..... 222/181; 222/207; 222/453; 222/476; 222/568

[58] Field of Search ..... 222/181, 185, 207, 209, 222/212, 213, 380, 383, 450, 451, 453, 476, 494, 495, 568, 570, 571

[56] References Cited

U.S. PATENT DOCUMENTS

| | | | |
|---|---|---|---|
| 1,176,653 | 3/1916 | Chow . | |
| 2,735,592 | 2/1956 | Stanger | 222/449 |
| 2,772,817 | 12/1956 | Jauch | 222/207 |
| 2,898,014 | 8/1956 | Borah | 222/570 X |
| 3,047,195 | 7/1962 | Richmond | 222/570 |
| 3,076,581 | 2/1963 | Booth | 222/453 |
| 3,134,514 | 5/1964 | Booth | 222/207 |
| 3,203,603 | 8/1965 | Benson | 222/494 |
| 3,493,146 | 2/1970 | Conners et al. | 222/153 |
| 3,545,651 | 12/1970 | Lewis | 222/181 |
| 3,828,985 | 8/1974 | Schindler | 222/209 X |
| 4,193,516 | 3/1980 | Purdy et al. | 222/57 |
| 4,222,501 | 9/1980 | Hammett et al. | 222/207 |
| 4,243,160 | 1/1981 | Reil | 222/207 X |
| 4,249,675 | 2/1981 | Nilson | 222/207 |
| 4,347,875 | 9/1982 | Columbus | 222/108 X |
| 4,498,510 | 2/1985 | Minshew, Jr. et al. | 222/108 X |
| 4,773,569 | 9/1988 | Larsson | 222/181 |
| 4,776,495 | 10/1988 | Vignot | 222/207 |
| 4,828,150 | 5/1989 | Bottger | 222/207 |

FOREIGN PATENT DOCUMENTS

| | | | |
|---|---|---|---|
| 1548946 | 10/1970 | Fed. Rep. of Germany | 222/207 |
| 3214499 | 10/1983 | Fed. Rep. of Germany . | |
| 3308013 | 9/1984 | Fed. Rep. of Germany . | |
| 1030780 | 1/1951 | France | 222/478 |
| 345439 | 5/1960 | France | 222/207 |
| 8008366 | 11/1980 | Sweden . | |
| 2119029 | 4/1982 | United Kingdom . | |

*Primary Examiner*—Kevin P. Shaver
*Attorney, Agent, or Firm*—Wegner & Bretschneider

[57] ABSTRACT

A dispensing device for flowing substances is attachable to a container and comprises an outlet tube of flexible material adapted to be dependent from the container and at the bottom terminated by an outlet opening. The dispensing device comprises valve arrangement for controlling flow of the substance through the device. Furthermore, the dispensing device comprises an intermediate piece comprising a first portion for releasably securing the outlet tube to the intermediate piece and a second portion for releasably securing the intermediate piece to communicate with a discharge opening of the container. The intermediate piece comprises a valve seat for restricting movement upwardly of the valve arrangement on squeezing of the flexible outlet tube.

15 Claims, 3 Drawing Sheets

DEVICE FOR DISPENSING FLOWING SUBSTANCES

The present invention is related to a dispensing device for flowing substances, in particular pasty masses, such as mustard and ketchup, the device being of the type comprising an outlet tube of flexible material attachable to a container to depend therefrom and being at the bottom thereof terminated by an outlet opening.

In restaurant business there are used large quantities of mustard, ketchup, mayonnaise and similar pasty type masses which are dispensed whenever a need therefor arises. Especially in coffee shops and similar quick serving facilities, the available space frequently is limited and the handling of, for instance, ketchup and mustard which are stored in plastic containers placed on a table or shelf and which have to be turned around each time they are used, is very time wasting. In addition, the containers as well as the surrounding are easily smeared.

Dispensing devices of this nature are also useful for dispensing other flowing substances, such as soap etc.

In the U.S. Pat. No. 4,773,569 assigned to the assignee in the present application, there is disclosed a dispensing device, which is attachable directly to a container, the neck piece of which comprises a valve seat for cooperating with a valve member of a valve arrangement controlling the dispensing of the substance in question. Thus, the containers must be specifically manufactured to fit the valve arrangement. Since containers of this nature are normally manufactured by means of a blowing technique, it is difficult to obtain a valve seat with good precision. Thus, it may happen that the valve seat of the container is so irregular that a considerable amount of leakage occurs when a valve member of the valve arrangement is in contact with the valve seat. The result is that a considerable amount of the substance in question may be pressed back into the container although such flow actually should be avoided during the dispensing operation.

Furthermore, forming of the valve seat integrally with the container makes it impossible to use the dispensing device with other containers not specifically manufactured for cooperating with the dispensing device.

One object of the present invention is to provide a dispensing device capable of being used with a variety of containers.

Another object of the invention is to provide a dispensing device having an intermediate piece interconnecting the outlet tube and the container in question.

Yet another object of the invention is to provide a dispensing device making it unnecessary to provide the container with a valve seat or other configuration for cooperation with the valve arrangement of the dispensing device.

Another object of the invention is to provide a dispensing device which comprises a valve seat on its own for cooperation with a valve member of the valve arrangement, said valve seat being possible to manufacture by means of injection moulding technique.

According to one aspect of the present invention, the dispensing device comprises an intermediate piece serving for interconnecting the outlet tube and the container, said intermediate piece comprising means for restricting the movement upwardly of the valve arrangement. Said restricting means has generally speaking the nature of a valve seat cooperating with a first valve member of the valve arrangement to open and close respectively the flow of the substance.

It is preferred that the valve seat is formed on an internal shoulder of the intermediate piece, said shoulder also comprising means for sealingly contacting a threaded neck piece of the container.

It is preferred that the intermediate piece is manufactured by injection moulding technique so that the shape of the valve seat may be accurately adapted to the shape of the first valve member of the valve arrangement.

The intermediate piece comprises means for sealingly contacting the flexible outlet tube.

Since the intermediate piece is releasable from the outlet tube, it is possible to manufacture various versions of the intermediate piece, said various versions having varying design to match different containers.

Furthermore, it is preferred that the intermediate piece defines an internal chamber, in which the first valve member of the valve arrangement is received when the outlet tube and the intermediate piece are in mutual engagement.

Containers of the nature primarily in question have normally an externally threaded neck piece. A widely used, standardized neck piece design has a so called 40 mm thread. It is preferred that at least one design of the intermediate piece is such that the intermediate piece comprises an internally threaded portion of such design that it may enter into thread engagement with such a standardized 40 mm thread. Thus, the dispensing device including the intermediate piece may be delivered as a unit and may be attached by the consumer to any container on the market having such a standardized 40 mm thread.

Other features, advantages and preferable embodiments of the invention will appear hereinafter.

The invention will now be described, by way of example, with reference to the accompanying drawings, in which.

Figure 1:
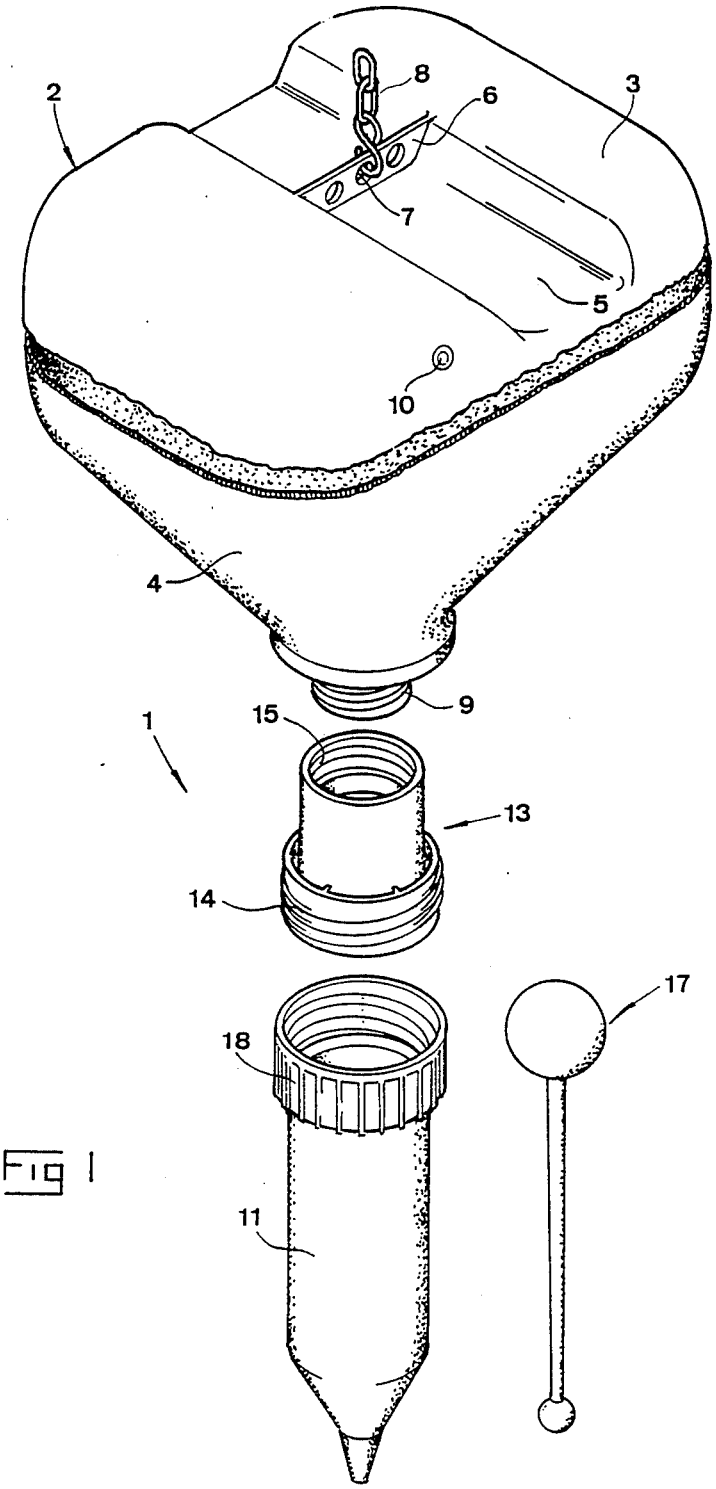
FIG. 1 shows the dispensing device according to the invention in a partly exploded view, a container, to which the dispensing device is attachable, also being illustrated in a view partially cut away.

The dispensing device 1 according to the invention is devised so as to be attachable to a container 2.

The container 2, which shall serve both as a transport package and a feeding-out store, is an expendable unit, preferably manufactured of plastics. It may in practice have any arbitrary form but has preferably a substantially planar first end face 3 and a truncated second end face 4.

The first end face 3 permits the container to stand with its outlet directed upwardly during storage and transportation. A groove 5 runs diametrically across the first end face, having open ends at its margin. Transversally across the groove, and about at the gravity center line of the container, a bracket 6 may be provided, not projecting above the otherwise plane surroundings. In the bracket 6 there is a hole 7, in which a suspension string, such as a chain 8, may be engaged for hanging the container in upturned position. When the container is suspended by the chain engaging in the bracket, it can be moved in a horizontal plane with the outlet pipe directed downwardly. As an alternative it would also be possible to dispense with the groove 5, the bracket 6 and the chain 8 and instead arrange a funnel like holder for the container, in which the truncated portion 4 of the container would be received. Said funnel like holder would have a central opening opposite to the discharge opening of the container, said central opening also allowing the dispensing device 1 to extend downwardly therethrough and below the funnel shaped holder.

The container 2 comprises a threaded annular neck piece 9 defining the discharge opening of the container. During transportation and storage of the container it will be closed by a lid of a conventional nature and not illustrated in the drawings. To facilitate the fluid to flow out of the container 2 during dispensing, it is necessary to permit air to enter the container. This is therefore, adjacent to the plane first end face 3, provided with means 10 for this purpose. Said means may be formed by a locally thinned spot in the wall material of the container. This spot can easily be punctured when the container is prepared for use.

The dispensing device 1 comprises an outlet tube 11 made of flexible material, for instance plastics or rubber, and has an outlet opening 12 at its distal end. i.e. the end of the tube which is the lowest in use. The dispensing device comprises an intermediate piece 13, which in turn comprises first means 14 for releasably securing the intermediate piece to the outlet tube 11 and second means 15 for releasably securing intermediate piece to communicate with the discharge opening 30 of the container. Furthermore, said intermediate piece 13 comprises means 16 for restricting movement upwardly of a valve arrangement 17 on squeezing of the outlet tube 11.

The means 14 of the intermediate piece comprises an externally threaded annular portion for cooperation with an internally threaded annular member or collar 18 associated to the outlet tube 11. The means 15 for releasably securing the intermediate piece 13 relative to the container 2 comprises an internally threaded portion adapted to cooperate with the externally threaded neck piece 9. The valve arrangement 17 is located at least partly within the outlet tube 11 and comprises two valve members 19, 20. A first 19 of said valve members is arranged in the vicinity of the upper end of the outlet tube for opening and closing respectively a communication opening 21, which is defined and surrounded by the restricting means 16 as will be explained in more detail hereinafter, via which communication opening the substance in question may flow from the container 2, through the intermediate piece 13 and into the outlet tube 11.

The second valve member 20 is located in the vicinity of the outlet opening 12 for opening and closing respectively thereof. The valve members 19, 20 are interconnected by a connection member 22, which maintains a predetermined distance between the valve members. The restricting means 16 comprises an annular valve seat defining the communication opening and adapted for cooperation with the first valve member 19. The connection member 22 is preferably of a rod like nature and has such a length that it maintains the valve member 19 in a position just below the seat 16 therefor adjacent the discharge charge opening 30 of the container. This situation is illustrated in FIG. 2 and it also appears therefrom how the valve arrangement is located in the tube so that the lower valve member 20 is located close to the outlet opening 12 while sealingly engaging the interior wall of the lower portion of the outlet tube 11, whereas the upper valve member 19 is located protruding upwardly past the upper end of the flexible outlet tube 11 and situated under the valve seat 16.

The width of the connection member 22 transversely to the longitudinal direction of the tube 11 is substantially smaller than the width of the valve member 19 in the same transverse direction. It is apparent from the foregoing description that the lower valve member 20 and the connection member 22 form means for preventing the valve member 20 from sinking downwardly in the tube 11.

The sectional area of the valve member 19 transversely in the longitudinal direction of the tube is substantially greater than the sectional area of the valve member 20. In the embodiment illustrated both valve members are formed as balls although this by no means is any requirement for the invention.

Figure 2:
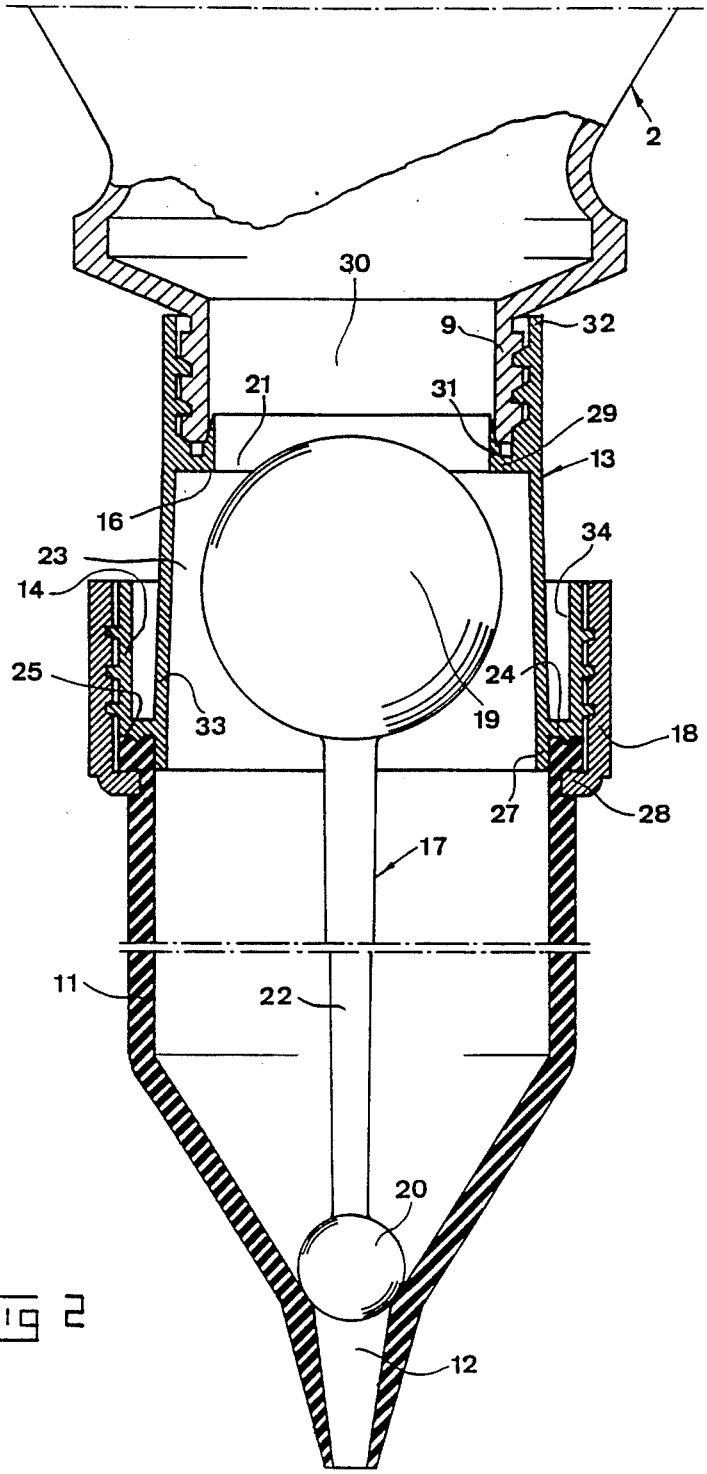
FIG. 2 shows on a larger scale the dispensing device and the discharge portion of the container in a longitudinal section.

It is preferred that the valve arrangement 17 has a density which is higher than the density of the substance to be dispensed so that the valve arrangement obtains a tendency to sink downwardly to the position in FIG. 2 under the influence of gravity also when the outlet tube 11 is entirely or almost entirely filled with such substance.

The outlet tube 11 has a sufficient length for allowing gripping of the tube by hand exteriorly on the tube in an area between the valve members 19, 20 without mechanically affecting the valve members. Also, the diameter of the tube is chosen so as to allow convenient gripping of the tube with a hand, with the full length thereof. Furthermore, the valve arrangement 17 is adapted to be influenced by fluid pressure in the tube 11 upon squeezing of the tube by hand so as to close the communication opening 21 by means of valve member 19 and open the outlet opening 12 by means of the valve member 20. On the other hand, upon release of squeezing pressure exteriorly on the tube 11, the valve member 19 will open the discharge opening and the valve member 20 will close the outlet opening 12.

When the tube 11 is squeezed by hand, the fluid within tube 11 will be imparted an overpressure, which due to the differing sectional areas of the valve members 19 and 20 will lift the valve arrangement 17 so as to make valve member 19 engage with its seat 16 and close the communication opening inside said annually continuous seat. Thus, the fluid is then prevented from flowing back into the container and is forced out through the opening 12 since valve member 20 has been lifted to open the same. When squeezing is interrupted, the flexible nature of the tube 11 will tend to make it return to its original tubular shape and this causes an underpressure in the tube 11, which tends to assist in returning the valve arrangement 17 to its position according to FIG. 2 so as to open the communication opening 21 and close the outlet opening 12. Furthermore, such underpressure will tend to suck substance into the tube 11 from the container. Of course, also the column of the substance in the container 2 will tend to return the valve arrangement 17 to its position in FIG. 1 upon termination of squeezing force. Finally, also gravity will tend to return the valve arrangement 17 to said position.

The intermediate piece 13 has a tubular shape and defines an internal chamber 23 for receiving the first valve member 19. The length of the connection member 22 interconnecting the valve members 19 and 20 is chosen so as to hold valve member 19 mainly inside the chamber 23 when the lower valve member 20 rests at the opening 12 of the outlet tube. Thus, valve member 19 will obtain a protected position within the chamber 23 of the intermediate piece 13 and accordingly, valve member 19 cannot be accidentally gripped by the hand during a squeezing operation. The transverse width of the chamber 23 is larger than the transverse width of valve member 19 and accordingly there is a flow passage around the upper valve member 19 to keep the outlet tube filled.

The outlet tube 11 is terminated in a truncated portion having the opening 12 at its end. Internally, the truncated portion is formed as a seat for the lower valve member 20 so that dribbling is avoided.

Figure 3:
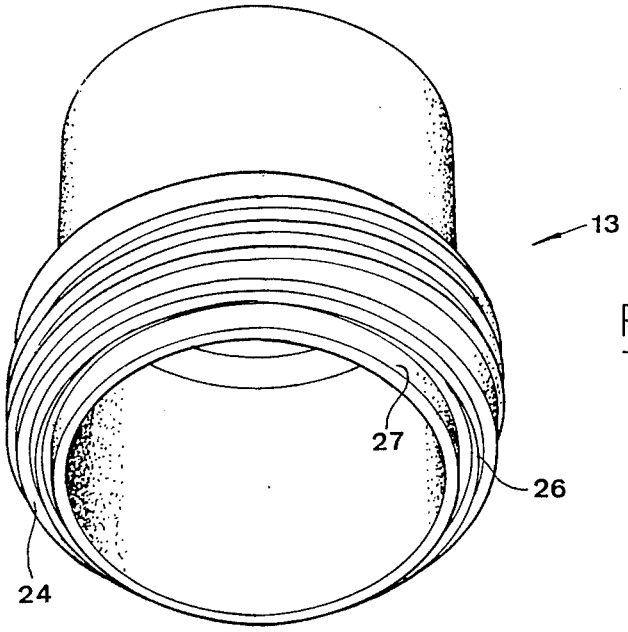
FIG. 3 shows the intermediate piece in a perspective view obliquely from below.
Figure 4:
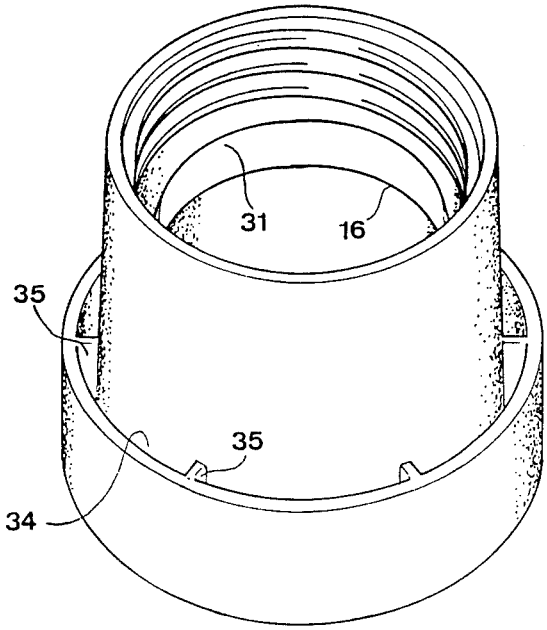
FIG. 4 shows the intermediate piece in a perspective view obliquely from above.

The collar 18 is formed by a piece releasably engaging with the outlet tube 11. The intermediate piece 13 comprises an annular ledge 24 (FIG. 3) for sealingly contacting a generally axially facing surface portion 25 of the outlet tube 11. This ledge 24 comprises an annular projection 26 adapted to be pressed into the generally axially facing surface portion 25 of the outlet tube 11 in order to obtain good sealing therebetween.

The intermediate piece 13 comprises an annular, generally axially directed flange 27 projecting into the outlet tube 11 radially inwardly of the ledge 24.

The collar 18 comprises at its lower end an annular radially inwardly directed flange 28 entering into a circumferential groove on the exterior side of the outlet tube 11. This flange 28 serves to press a portion at the upper end of the outlet tube 11 between itself and the ledge 24 of the intermediate piece 13, the flange 27 thereof preventing the uppermost portion of the outlet tube 11 from deflecting inwardly of the intermediate piece 13.

The valve seat 16 is formed on an annular internal shoulder 29 on the substantially tubular intermediate piece 13, said shoulder 29 sealingly cooperating with the neck piece 9 of the container. More specifically, the shoulder 29 comprises an annular lip 31 protruding into the interior of the neck piece 9 and sealingly contacting the extreme edge of the threaded neck piece 9. The lip 31 is designed so as to contact the edge of the neck piece 9 resiliently whereas an upper portion 32 of the intermediate piece 13 serves as a stop member by abutting against an annular area of the container 2 just outside the neck piece 10.

The ledge 24 forms a bridge between a wall portion 33 of the intermediate piece 13 defining the chamber 23 and the externally threaded portion 14. The externally threaded portion 14 is located externally of the wall portion 33. The wall portion 33 and the externally threaded portion 14 of the intermediate piece 13 are separated by alternating interspaces and angularly mutually displaced webs 35, said webs being integral with the intermediate piece.

The flange 27 on the intermediate piece 13 is a generally axial extension of the wall portion 33 beyond the ledge 24.

It can be seen from FIG. 2 that the wall portion 33 defining the chamber 23 is slightly conical with the larger diameter at the bottom.

The dispenser is primarily intended for pasty matter but may be used with lighter fluids as well as with heavier fluids, such as various dressings containing chopped onions, pickled gherkins or the like.

The intermediate piece 13 may of course be manufactured in various embodiments having differing designs as to the means 15 for securing the intermediate piece relative to the container in dependence upon various container embodiments. The term "container" should be interpreted in its widest sense. Thus, the dispensing device according to the invention is not limited to use with containers manufactured in one piece. For instance, it would be possible to use the dispensing device according to the invention with tin cans or similar. In such a case the tin can in question would be opened and a particular outlet piece secured thereto. Then the dispensing device according to the invention would be brought into engagement with a threaded neck piece of said outlet piece. Thus, in such a case the tin can and the outlet piece would jointly form the container attachable to the intermediate piece of the dispensing device according to the invention. In similar fashion, the container could have the nature of a flexible bag comprising or being connectable to an outlet piece engagable with the intermediate piece of the device according to the invention.

What I claim is:

1. A dispensing device for flowing substances, said device being attachable to a container and comprising an outlet tube of flexible material adapted to be dependent from the container and at the bottom terminated by an outlet opening, said dispensing device further comprising a valve arrangement comprising two valve members, a first of said valve members being arranged in the vicinity of the upper end of the outlet tube for opening and closing respectively a communication opening, via which the substance may flow from the container into the outlet tube, a second of said valve members being arranged in the vicinity of the outlet opening for opening and closing respectively thereof, said outlet tube having a sufficient length for allowing gripping of the tube by hand in an area between the valve members and squeezing of the tube without mechanically affecting the valve members, said valve arrangement being adapted to be influenced by the fluid pressure in the tube upon squeezing thereof so as to close the communication opening by means of the first valve member and open the outlet opening by means of the second valve member, whereas upon release of squeezing pressure the first valve member opens the communication opening and the second valve member closes the outlet opening, said device comprising an intermediate piece comprising first means for releasably securing the outlet tube to the intermediate piece and second means for releasably securing the intermediate piece to communicate with a discharge opening of the container, said intermediate piece comprising means for restricting movement upwardly of the valve arrangement on squeezing of the outlet tube.

2. A device according to claim 1, wherein said restricting means comprises a valve seat defining the communication opening and adapted for cooperation with the first valve member.

3. A device according to claim 1, wherein said intermediate piece has a tubular shape and defines an internal chamber for receiving the first valve member.

4. A device according to claim 3, wherein the valve arrangement comprises a connection member interconnecting the first and second valve members and the length of the connection member is sufficient to hold said first valve member mainly within said chamber, when the second valve member is in its closing position.

5. A device according to claim 1, wherein the first means for releasably securing the intermediate piece to the outlet tube comprises an externally threaded portion for cooperation with an internally threaded collar associated to the outlet tube.

6. A device according to claim 5, wherein the collar is formed by a piece releasably engaging with the outlet tube.

7. A device according to claim 1, wherein the intermediate piece comprises a annular ledge for sealingly contacting a generally axially facing surface portion of the outlet tube.

8. A device according to claim 7, wherein the ledge comprises an annular projection adapted to be pressed into the generally axially facing surface portion of the outlet tube.

9. A device according to claim 7, wherein the intermediate piece comprises an annular, generally axially directed flange projecting into the outlet tube radially inwardly of the ledge.

10. A device according to claim 1, wherein the second means for releasably securing the intermediate piece relative to the container comprises an internally threaded portion adapted to cooperate with an externally threaded portion surrounding the discharge opening of the container.

11. A device according to claim 1, wherein said restricting means of the substantially tubular intermediate piece comprises an annular internal shoulder directed inwardly of the intermediate piece, said shoulder sealingly cooperating with a portion of the container defining the discharge opening thereof.

12. A device according to claim 11, wherein the portion of the container defining the discharge opening is a threaded neck piece and the shoulder comprises an annular lip protruding into the interior of the neck piece and sealingly contacting the extreme edge of the threaded neck.piece.

13. A device according to claim 1, wherein said intermediate piece has a tubular shape and defines an internal chamber for receiving the first valve member, the first means for releasably securing the intermediate piece to the outlet tube comprises an externally threaded portion for cooperation with an internally threaded collar associated to the outlet tube, the intermediate piece comprises an annular ledge for sealingly contacting a generally axially facing surface portion of the outlet tube, said ledge forming a bridge between a wall portion of the intermediate piece defining said chamber and said externally threaded portion, said externally threaded portion being located externally of said wall portion.

14. A device according to claim 13, characterized in that the wall portion and the externally threaded portion of the intermediate piece are separated by alternating spaces and angularly mutually displaced webs, said webs being integral with said intermediate piece.

15. A device according to claim 13, wherein the intermediate piece comprises an annular, generally axially directed flange projecting into the outlet tube radially inwardly of the ledge and said flange is a generally axial extension of the wall portion beyond said ledge.

* * * * *